US006164097A

United States Patent [19]

McBryde

[11] Patent Number: 6,164,097

[45] Date of Patent: *Dec. 26, 2000

[54] PORTABLE LOCKING DEVICE FOR PROTECTION OF STRINGED INSTRUMENTS

[76] Inventor: Brett McBryde, 9508 Trinity, Eagle River, Ak. 99577

[ * ] Notice: Under 35 U.S.C. 154(b), the term of this patent shall be extended for 176 days.

[21] Appl. No.: 08/539,353

[22] Filed: Oct. 5, 1995

[51] Int. Cl.[7] ..... E05B 69/00

[52] U.S. Cl. ..... 70/58; 70/18

[58] Field of Search ..... 70/14, 18, 19, 70/57–59, 61, 62, 64–66, 232; 211/4, 7–9; 224/910; 84/453

[56] References Cited

U.S. PATENT DOCUMENTS 5,544,505 8/1996 McIntosh et al. ..... 70/18

*Primary Examiner*—Suzanne Dino Barrett

*Attorney, Agent, or Firm*—David S. Woronoff

[57] ABSTRACT

An apparatus for locking musical instruments having "necks" to a fixed structure having first and second rigid arm members each having a curved portion and a straight portion; in which the first and second rigid arm members are mirror images of each other; mating eye members are attached to each of said first and second arm members curved portion and mating hinge forming means are attached to each of the first and second arm members straight portion in which each of said first and second arm members has an inner surface for engaging the "neck" of a musical instrument and each of said first and second arm members inner surface has a soft resilient portion and extending chain or cable adapted to fit through the eye means of the first and second arms for engaging a fixed structure.

3 Claims, 3 Drawing Sheets

PORTABLE LOCKING DEVICE FOR PROTECTION OF STRINGED INSTRUMENTS

BACKGROUND OF THE INVENTION

The present invention relates to the safe keeping of guitars or other similar relatively fragile string instruments, including but not limited to, violins, violas, bass fiddles, ukuleles, mandolins, bass guitars, banjos and the like.

FIELD OF THE INVENTION

The present invention relates to the field of devices used by musicians and others for the safekeeping of stringed instruments having "necks" such as guitars, violins, violas, bass fiddles, ukuleles, mandolins, bass guitars, banjos and the like.

DESCRIPTION OF THE PRIOR ART

The closest prior art known to the applicant is U.S. shown by U.S. Pat. Nos. 2,700,289; 4,059,209; 3,999,409; and 4,326,747. The '289 patent issued to Morgan shows a lock for a cue stick which has an oval band formed with a ratchet leg on each side of the oval for engaging a padlock body. The top of the oval has ring member attached to it. The '289 lock functions to prevent practical use of the cue stick but not its theft when the lock may be removed at leisure.

The '209 patent issued to Grisel shows a device for fastening skis and ski poles to a wall rack. The device has a closed clamshell like appearance with the upper ends of the opposite sides of the shells near the shell hinge removed to form a carrying handle. The shell base has two tubular members formed thereon adapted to receive two tubular receiving posts. The shell tubular members have a locking tab or cam which engages a portion of the receiving posts.

The '409 patent to Bell is physically similar in many ways to the '209 patent of Grisel except that it does not have the handle structure of the identical locking structure of Grisel.

The '747 patent to Finnegan shows a tong like structure for a portable ski lock. The tongs are pivoted near one end of the legs and have straight flat sides for engaging and holding the skis. One end of the tongs is formed into a pair of handles for carrying the skis.

SUMMARY OF THE INVENTION

The present invention teaches a novel apparatus formed of mirror image arm members each having a straight portion and a curved portion which are adapted by a hinge or hook and eye mechanism for mutual rotation. The curved portion of each arm has one or more mating eye members through which can be fitted a locking chain or cable which is locked to a fixed structure. The arms have resilient inner surfaces for engaging the "neck" of the musical instrument to be locked to the fixed structure.

DESCRIPTION OF THE PREFERRED EMBODIMENT

Figure 1:
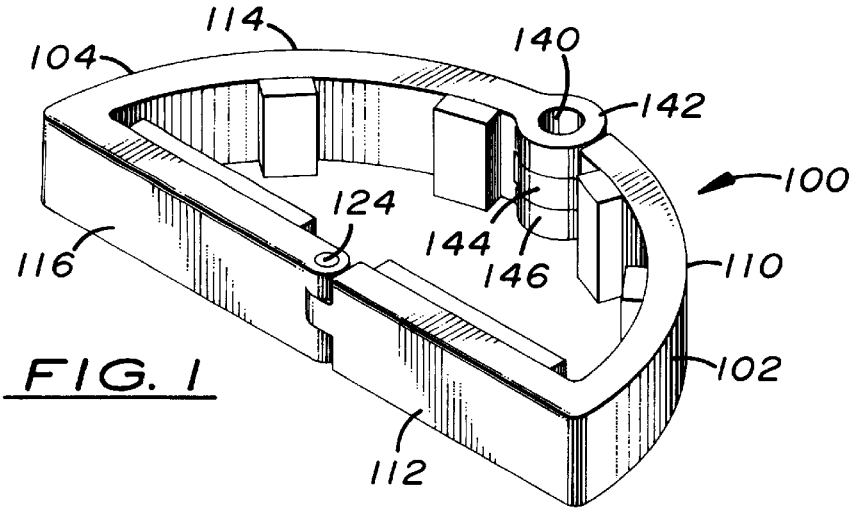
FIG. 1 shows a front perspective of one embodiment of the present invention.

FIG. 1 is perspective view of a first embodiment of the present invention shown generally by the number 100. The first embodiment has two arms 102 and 104 which when rotatably joined by the hinge 124 and closed at the locking loop 140 forms a semicircle (when viewed from the top). The hinge may be formed of mating sleeves 112, 116 having circular cross-sections 120, 122 or any other alternative hinge structure.

The arms 102 and 104 have curved portions 110, 114 and straight portions 112, 116. Eyes 142, 146 and 144 are formed on or attached to the curved portion of the arms 114, 110. The eyes 142, 146 and 144 are adapted to mate to form a passageway 140 through which a locking cable or chain 150 having loops 152, 154 formed on each end which form eyes 156, 157 through which a lock (shown in FIG. 10) may pass.

Resilient pads 160 are attached to the curved portion of the arms 110, 114 and resilient pads a70 are attached to the straight portions 112, 116 of the arms.

Figure 2:
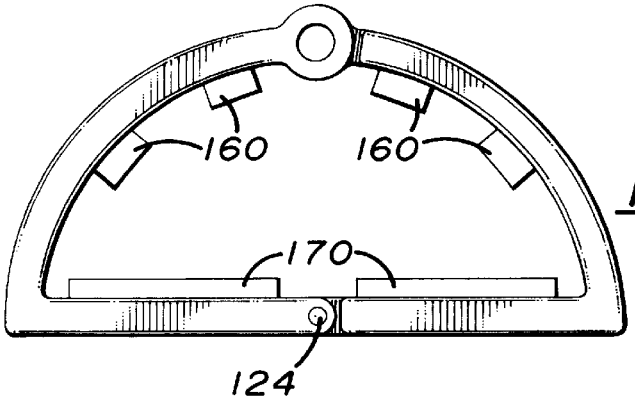
FIG. 2 is a top view of the embodiment shown in FIG. 1.
Figure 4:
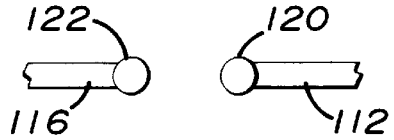
FIG. 4 shows a detail of the hinge mechanism shown in FIGS. 1, 2 and 3.
Figure 3:
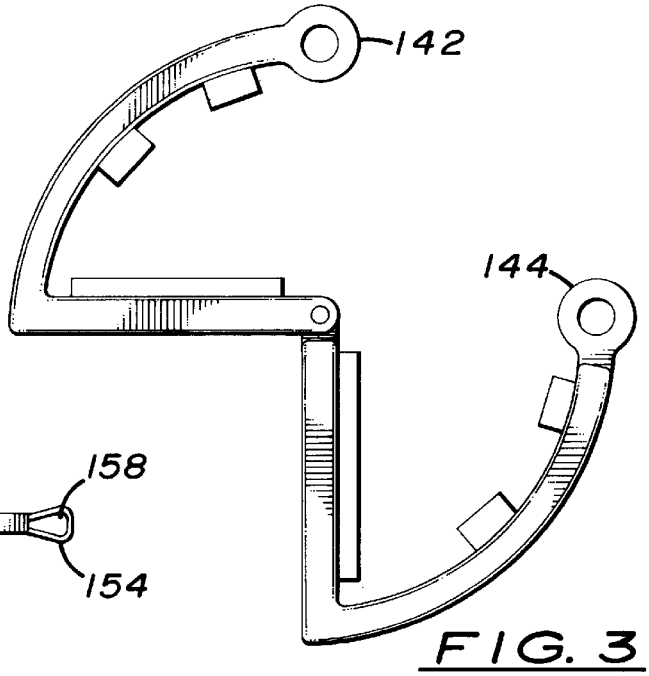
FIG. 3 shows a top perspective view of an embodiment of the present invention in the "open" or unlocked mode.
Figure 5:
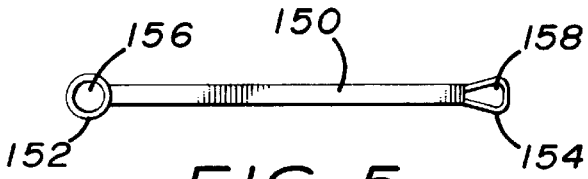
FIG. 5 shows a top view of a locking cable being a part of an embodiment of the present invention.
Figure 6:
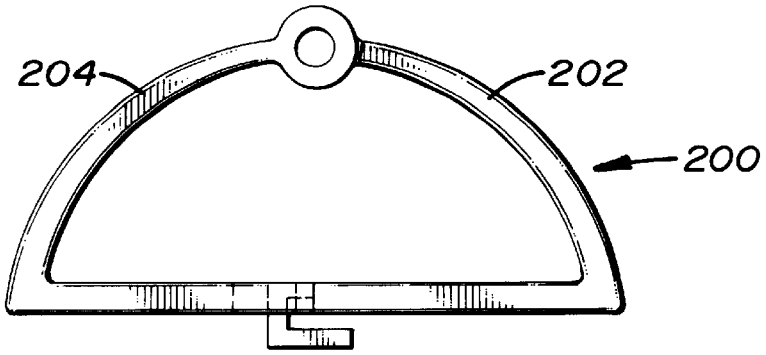
FIG. 6 shows a top view of a second embodiment of the present invention.
Figure 7:
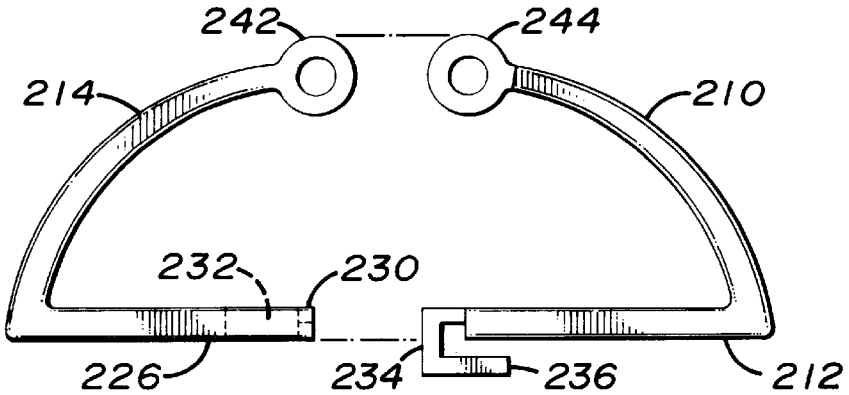
FIG. 7 shows an exploded top view of the embodiment shown in FIG. 6.
Figure 8:
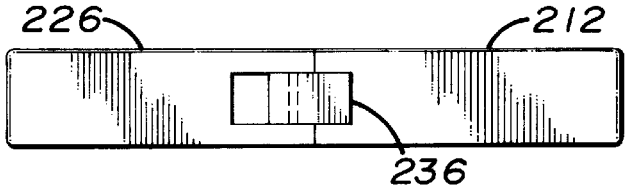
FIGS. 8 and 9 show a part of the second embodiment shown in FIGS. 6 and 7 in which the detailed structure of the engagement of the two arms of the inventive device is shown engaged (FIG. 8) and disengaged (FIG. 9).
Figure 9:
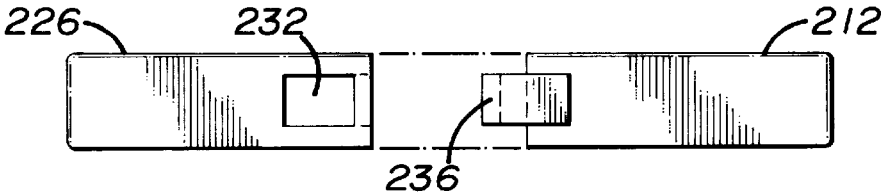

FIGS. 7, 8 and 9 show a second embodiment of the invention in which parts similar to those in FIGS. 1, 2 and 3 have the same numbers preceded by a "2" instead of a "1", i.e., part 204 and part 104 are similar. The primary difference between embodiments 1 and 2 is that the second embodiment uses an "L" shaped hook, 234, 236 and aperture 232 formed in arm 216 as the structure for permitting the relative rotation of the arms 202, 204.

Figure 11A:
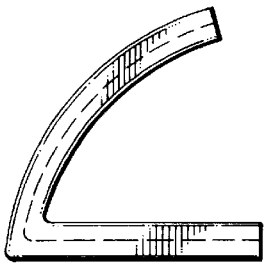
FIG. 11 shows three views of pads which formed a part of the embodiments of the present invention
Figure 11B:
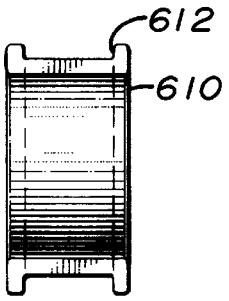
Figure 11C:
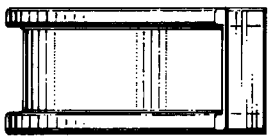
Figure 11:
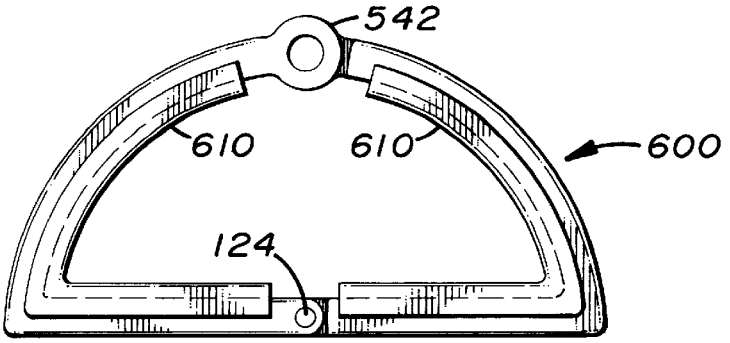

FIG. 11 shows another embodiment in side, front and top view of pads 610 which have generally "U" shaped channels formed in them to mate with the arms of the locking device 600 as shown in the figure.

Figure 10:
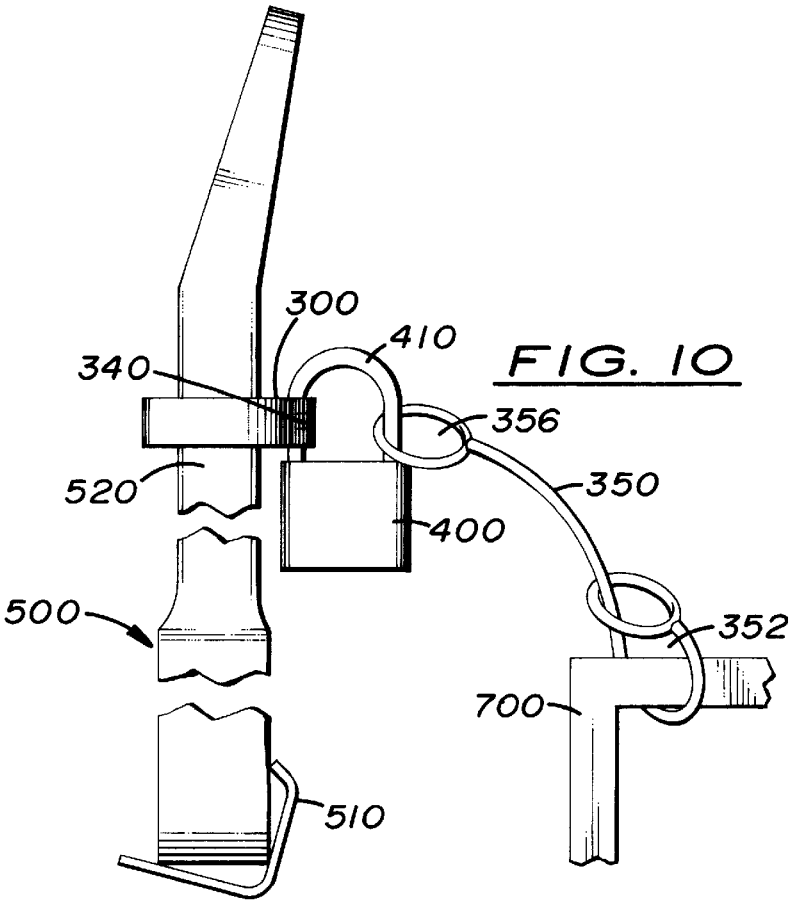
FIG. 10 shows the locking apparatus in operation locked to a fixed structure or a much heavier object than the instrument.

FIG. 10 shows the inventive locking device 300 locked in position around the throat 520 of an instrument 500 sitting on a stand 510. This embodiment of the device shows a padlock 400 fitted through the locking device 300 locking loop 340. The padlock is fitted through the eye 356 of the chain or cable 350 at one end and the cable is looped through eye 352 around a fixed or very heavy structure to secure the instrument.

The embodiments of the present invention which have been shown and described are illustrative of the main principles of the invention but the following claims shall not be limited to the embodiments shown. The claims are intended to cover and do cover those variations of the invention which are apparent to those skilled in the art.

I claim:

1. An apparatus for locking musical instruments having necks to a fixed structure comprising:

first and second relatively rigid arms;

each of said relatively rigid arms having length and thickness and having a first straight portion and a second curved portion forming a right angle at the point of connection of said portions;

each of said relatively rigid arms having a thickness small compared to the length of each said arm;

said rigid arms forming a single closed essentially semi-circular loop when mutually engaged;

said first and second arms formed into mirror images of each other for engaging the neck of the musical instrument;

each of said arms has first and second engaging means formed thereon for engaging the other arm; said first arm first engaging means is formed into an eye means;

said second arm first engaging means is formed into an eye means;

said first and second arms second engaging means are formed into first and second mating cylinder members which when engaged form a hinge means for permitting the relative rotation of the first arm with respect to the second arm.

2. The locking means claimed in claim 1 including further:

said first and second arms having surfaces for engaging the neck of the musical instrument;

said first and second arms straight and curved portions having said neck engaging surfaces thereon;

said neck engaging surfaces of said first and second arms being formed of a relatively soft resilient material.

3. The locking means claimed in claim 1 including further an extending means adapted to fit through the eye means of the first and second arms for engaging a fixed structure.

* * * * *